US010392966B2

(12) United States Patent
Caprario et al.

(10) Patent No.: US 10,392,966 B2
(45) Date of Patent: Aug. 27, 2019

(54) RETAINING RING END GAP FEATURES

(71) Applicant: United Technologies Corporation, Farmington, CT (US)

(72) Inventors: Joseph T. Caprario, Rocky Hill, CT (US); Noah Wadsworth, Sturbridge, MA (US); Mark E. Marler, Glastonbury, CT (US); James P. Allore, Manchester, CT (US); Elizabeth F. Vinson, Broad Brook, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 336 days.

(21) Appl. No.: 15/274,306

(22) Filed: Sep. 23, 2016

(65) Prior Publication Data

US 2018/0087397 A1 Mar. 29, 2018

(51) Int. Cl.

| | |
|---|---|
| ***F01D 25/04*** | (2006.01) |
| ***F01D 5/30*** | (2006.01) |
| ***F01D 5/32*** | (2006.01) |
| ***F01D 9/02*** | (2006.01) |

(52) U.S. Cl.

CPC ..... *F01D 25/04* (2013.01); *F01D 5/3015* (2013.01); *F01D 5/323* (2013.01); *F01D 9/02* (2013.01); *F05D 2220/32* (2013.01); *F05D 2260/30* (2013.01); *F05D 2260/36* (2013.01)

(58) Field of Classification Search

CPC ..... F01D 25/04; F01D 5/32; F01D 5/3015; F01D 5/3236; F01D 9/02; F05D 2260/36

See application file for complete search history.

(56) References Cited

U.S. PATENT DOCUMENTS

| | | | | |
|---|---|---|---|---|
| 4,304,523 | A | 12/1981 | Corsmeier et al. | |
| 5,622,475 | A * | 4/1997 | Hayner ..... | F01D 5/3015 416/219 R |
| 2002/0018719 | A1 | 2/2002 | Arilla et al. | |
| 2007/0237645 | A1 | 10/2007 | Garin et al. | |

FOREIGN PATENT DOCUMENTS

| | | | |
|---|---|---|---|
| EP | 0921272 | A2 | 6/1999 |
| EP | 1795709 | A2 | 6/2007 |
| JP | H10103007 | A | 4/1998 |

OTHER PUBLICATIONS

European Search Report for Application No. 17182485.7-1006/ EP17182465; dated Jan. 31, 2018; 9 pages.

* cited by examiner

*Primary Examiner* — Jason D Shanske
*Assistant Examiner* — Maxime M Adjagbe
(74) *Attorney, Agent, or Firm* — Cantor Colburn LLP

(57) ABSTRACT

A gas turbine engine and a retaining ring are disclosed. The gas turbine engine includes a rotating disc assembly, including a rotating disc, a cover plate, and a retaining ring disposed between the rotating disc and the cover plate, wherein the retaining ring axially retains the rotating disc and the cover plate, the retaining ring including a rotating disc face to interface with the rotating disc; a cover plate face to interface with the cover plate; and an end gap portion defining an end gap, wherein at least one of the rotating disc face, the cover plate face, and the end gap portion includes a stress reducing feature.

20 Claims, 5 Drawing Sheets

RETAINING RING END GAP FEATURES

STATEMENT REGARDING FEDERALLY SPONSORED RESEARCH AND DEVELOPMENT

This invention was made with government support under Contract No. N00019-02-C-3003 awarded by the United States Air Force. The government therefore has certain rights in this invention.

BACKGROUND

The present disclosure relates to retaining rings for gas turbine engines, and more particularly to retaining rings with end gap features for gas turbine engines.

Retaining rings for gas turbine engines can be utilized to retain a cover plate to a rotating disc within the engine. During operation, stress concentrations may form within the cover plate at the location of the retaining ring end gap that may cause contact stress and cracking.

Accordingly, it is desirable to provide retaining rings with end gap features that can prevent stress concentrations within the cover plate.

BRIEF SUMMARY

According to an embodiment, a retaining ring for use in a gas turbine engine includes a rotating disc face, a cover plate face, and an end gap portion defining an end gap, wherein at least one of the rotating disc face, the cover plate face, and the end gap portion includes a stress reducing feature.

In addition to one or more of the features described above, or as an alternative, further embodiments could include an axially extending face extending from the cover plate face.

In addition to one or more of the features described above, or as an alternative, further embodiments could include that the axially extending face includes the stress reducing feature.

In addition to one or more of the features described above, or as an alternative, further embodiments could include that the stress reducing feature is a radius tangent to at least one of the rotating disc face, the cover plate face, and the end gap portion.

In addition to one or more of the features described above, or as an alternative, further embodiments could include that the stress reducing feature is a contoured contact surface.

In addition to one or more of the features described above, or as an alternative, further embodiments could include that the stress reducing feature is a scalloped surface.

In addition to one or more of the features described above, or as an alternative, further embodiments could include that the stress reducing feature is a tapering surface.

According to an embodiment, a rotating disc assembly for use with a gas turbine engine includes a rotating disc, a cover plate, and a retaining ring disposed between the rotating disc and the cover plate, wherein the retaining ring axially retains the rotating disc and the cover plate, the retaining ring including a rotating disc face to interface with the rotating disc, a cover plate face to interface with the cover plate, and an end gap portion defining an end gap, wherein at least one of the rotating disc face, the cover plate face, and the end gap portion includes a stress reducing feature.

In addition to one or more of the features described above, or as an alternative, further embodiments could include an axially extending face extending from the cover plate face, wherein the axially extending face radially constrains the retaining ring against the cover plate.

In addition to one or more of the features described above, or as an alternative, further embodiments could include that the axially extending face includes the stress reducing feature.

In addition to one or more of the features described above, or as an alternative, further embodiments could include that the stress reducing feature is a radius tangent to at least one of the rotating disc face, the cover plate face, and the end gap portion.

In addition to one or more of the features described above, or as an alternative, further embodiments could include that the stress reducing feature is a contoured contact surface.

In addition to one or more of the features described above, or as an alternative, further embodiments could include that the stress reducing feature is a scalloped surface.

In addition to one or more of the features described above, or as an alternative, further embodiments could include that the stress reducing feature is a tapering surface.

According to an embodiment, a gas turbine engine includes a rotating disc assembly, including a rotating disc, a cover plate, and a retaining ring disposed between the rotating disc and the cover plate, wherein the retaining ring axially retains the rotating disc and the cover plate, the retaining ring including: a rotating disc face to interface with the rotating disc; a cover plate face to interface with the cover plate; and an end gap portion defining an end gap, wherein at least one of the rotating disc face, the cover plate face, and the end gap portion includes a stress reducing feature.

In addition to one or more of the features described above, or as an alternative, further embodiments could include an axially extending face extending from the cover plate face, wherein the axially extending face radially constrains the retaining ring against the cover plate.

In addition to one or more of the features described above, or as an alternative, further embodiments could include that the axially extending face includes the stress reducing feature.

In addition to one or more of the features described above, or as an alternative, further embodiments could include that the stress reducing feature is a radius tangent to at least one of the rotating disc face, the cover plate face, and the end gap portion.

In addition to one or more of the features described above, or as an alternative, further embodiments could include that the stress reducing feature is a contoured contact surface.

In addition to one or more of the features described above, or as an alternative, further embodiments could include that the stress reducing feature is a scalloped surface.

Other aspects, features, and techniques of the embodiments will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Embodiments provide a retaining ring with end gap features. The end gap features of the retaining ring can reduce contact stress on the cover plate during operation to prevent wear and improve life of the rotating disc assembly.

Figure 1:
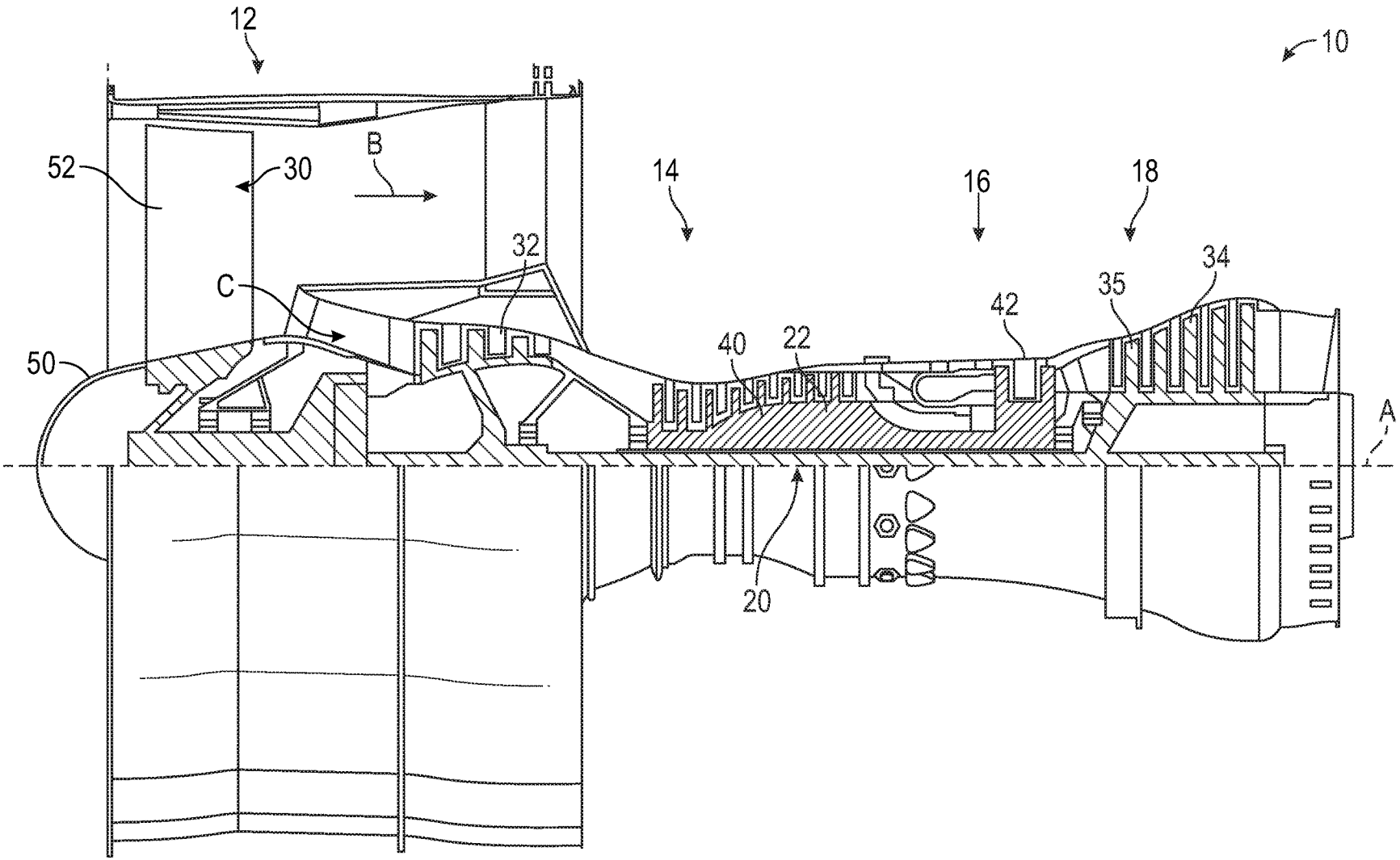
FIG. 1 is a schematic, partial cross-sectional view of a turbomachine in accordance with this disclosure.

Referring to FIG. 1 a schematic representation of a gas turbine engine 10 is shown. The gas turbine engine includes a fan section 12, a compressor section 14, a combustor section 16, and a turbine section 18 disposed about a longitudinal axis A. The fan section 12 drives air along a bypass flow path B that may bypass the compressor section 14, the combustor section 16, and the turbine section 18. The compressor section 14 draws air in along a core flow path C where air is compressed by the compressor section 14 and is provided to or communicated to the combustor section 16. The compressed air is heated by the combustor section 16 to generate a high pressure exhaust gas stream that expands through the turbine section 18. The turbine section 18 extracts energy from the high pressure exhaust gas stream to drive the fan section 12 and the compressor section 14.

The gas turbine engine 10 further includes a low-speed spool 20 and a high-speed spool 22 that are configured to rotate the fan section 12, the compressor section 14, and the turbine section 18 about the longitudinal axis A. The low-speed spool 20 may connect a fan 30 of the fan section 12 and a low-pressure compressor portion 32 of the compressor section 14 to a low-pressure turbine portion 34 of the turbine section 18. In the illustrated embodiment, the turbine section 18 can include a rotating disc assembly 35. The high-speed spool 22 may connect a high pressure compressor portion 40 of the compressor section 14 and a high pressure turbine portion 42 of the turbine section 18. The fan 30 includes a fan rotor or fan hub 50 that carries a fan blade 52. The fan blade 52 radially extends from the fan hub 50.

In the illustrated embodiment, the rotating disc assembly 35 can be a turbine disc assembly to extract energy from the high pressure exhaust gas stream by rotation of a plurality of turbine discs. The turbine disc assembly can utilize retaining rings to retain turbine discs and cover plates within the gas turbine engine 10. In certain embodiments, the compressor portion 32 can include a similar rotating disc assembly 35 to compress airflow by rotation of a plurality of compressor discs. The compressor disc assembly can utilize retaining rings to retain compressor discs and cover plates within the gas turbine engine 10.

Figure 2:
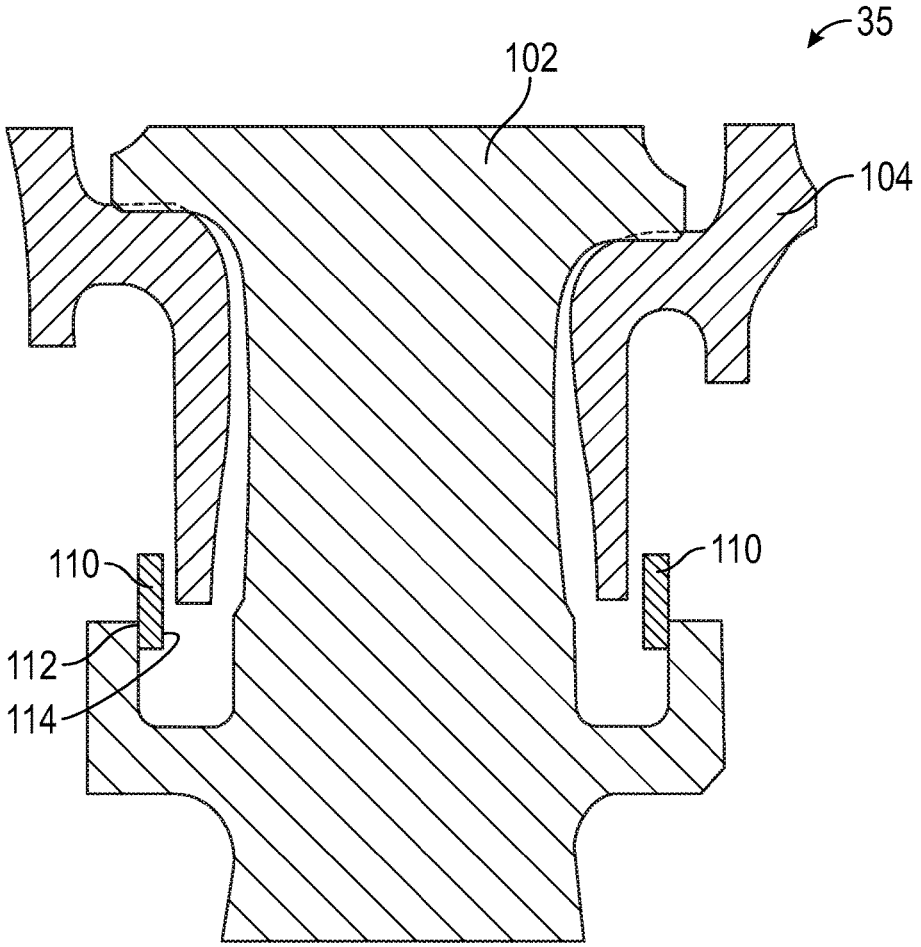
FIG. 2 is partial cross-sectional view of a rotating disc assembly for use with the turbomachine of FIG. 1.

Referring to FIG. 2, a rotating disc assembly 35 is shown. The rotating disc assembly 35 can be any suitable assembly, including, but not limited to a turbine disc assembly or a compressor disc assembly. In the illustrated embodiment, the rotating disc assembly 35 includes a rotating disc 102, a cover plate 104, and a retaining ring 110. The retaining ring 110 can prevent axial motion of the cover plate 104 relative to the rotating disc 102 to allow the rotating disc 102 and the cover plate 104 to be retained after assembly. The retaining ring 110 can be mounted against the lip of the rotating disc 102 to retain the cover plate 104 after assembly. In the illustrate embodiment, multiple retaining rings 110 can be disposed on either side of the rotating disc 102 to prevent axial motion on either side of the rotating disc assembly 35. In certain embodiments, rotating disc 102 can be a disc segment and other parts that are not complete discs. In certain embodiments, the rotating disc assembly 35 is suitable for use with parts to be retained that are not rotating.

Figure 3:
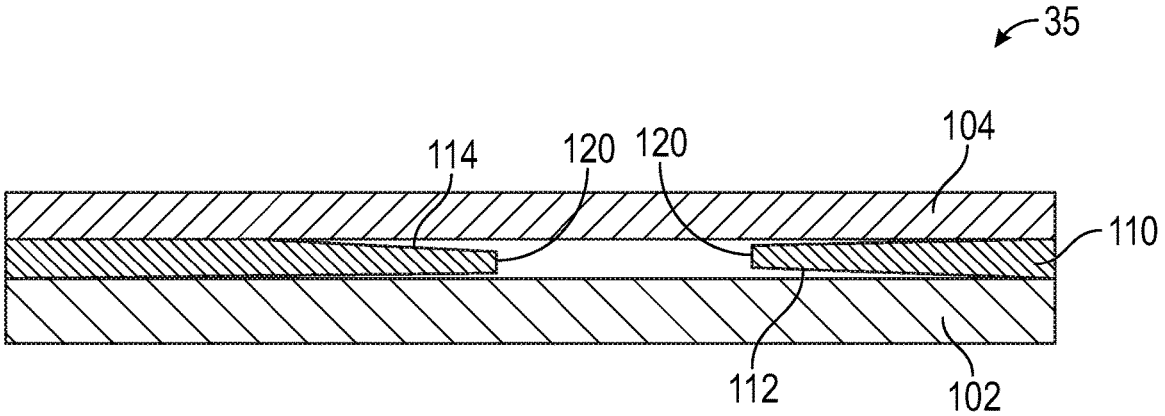
FIG. 3 is a partial plan view of the rotating disc assembly of FIG. 2.

Referring to FIGS. 2 and 3, the retaining ring 110 includes a rotating disc face 112, a cover plate face 114, and an end gap portion 120. The retaining ring 110 is a split ring that axially interfaces with the lip portion of the rotating disc 102 and the cover plate 104 via the rotating disc face 112 and the cover plate face 114 respectively. In certain embodiments, the retaining ring 110 can be formed from additive manufacturing processes, casting processes, machining processes or a combination thereof. Any other suitable process for manufacturing the retaining ring 110 is contemplated herein.

The split ring construction of the retaining ring 110 allows for an end gap formed between the end gap portions 120. Advantageously, with the use of the stress reducing geometries and features described herein, contact stresses of the cover plate 104 near the end gap defined by the end gap portions 120 can be reduced to improve life of the rotating disc assembly.

Referring to FIG. 3, the retaining ring 110 includes two tapered surfaces proximal to the end gap defined by the end gap portions 120. In the illustrated embodiment, the cover plate face 114 includes a tapered surface in the end gap portion 120. In the illustrated embodiment, the cover plate face 114 tapers away from the cover plate 104 to reduce stress concentrations experienced by the cover plate 104. Similarly, in the illustrated embodiment, the rotating disc face 112 includes a tapered surface in the end gap portion 120. In the illustrated embodiment, the rotating disc face 112 tapers away from the rotating disc 102 to reduce stress concentrations experienced by the cover plate 104.

Figure 4:
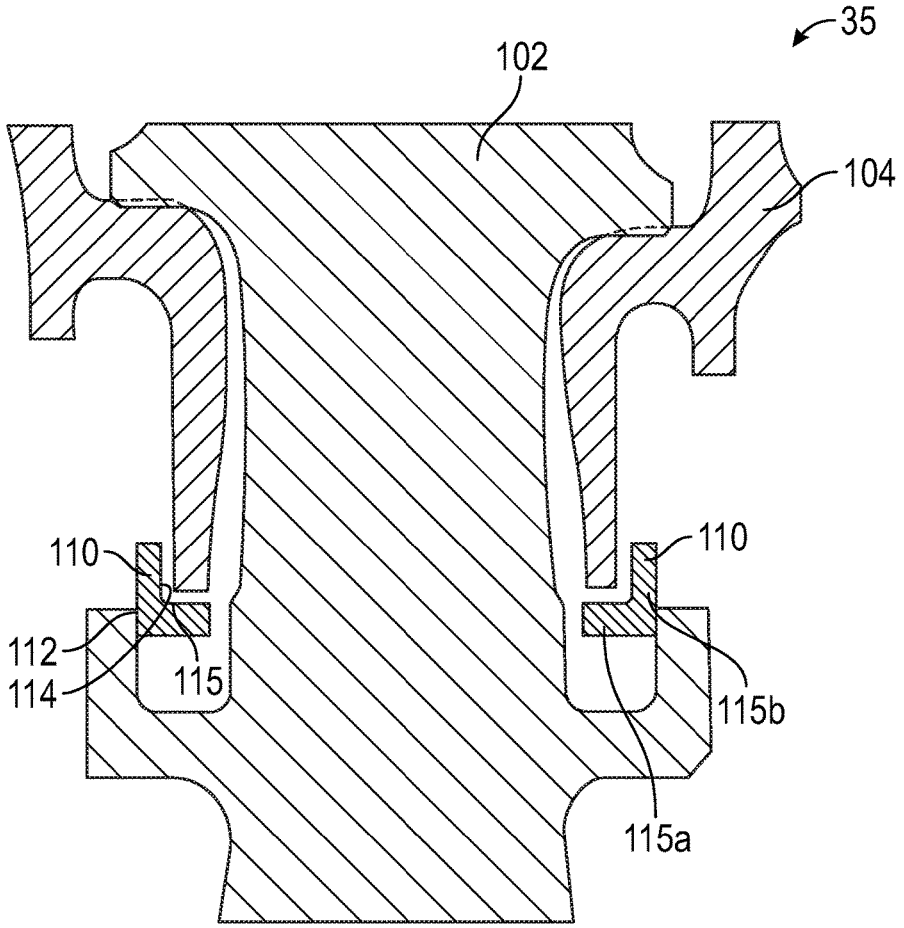
FIG. 4 is a partial cross-sectional view of another rotating disc assembly for use with the turbomachine of FIG. 1.

Further referring to FIG. 4, in certain embodiments, the retaining ring 110 includes an axially extending face 115 or first face on a first leg 115*a* of the retaining ring 110, the axially extending face 115 facing a radial direction. In the illustrated embodiment, the axially extending face 115 extends inward from the cover plate face 114 or second face that faces a first axial direction on a second leg 115*b* that is a radially extending leg of the regaining ring 110, to form a general "L" shape, wherein the rotating disc face 112 is a third face that faces a second axial direction that opposes the first axial direction. The axially extending face 115 can provide radial support to the cover plate 104 and further aid in assembly by locating the cover plate 104 and the retaining ring 110 during assembly. In certain embodiments, the axially extending face 115 can aid in reducing stress on the retaining ring 110 and the cover plate 104.

Referring to FIGS. 5A-7F, various embodiments of retaining rings 110 with various stress reducing features are shown and described. Stress reducing features and geometries described herein can be combined to form a desired retaining ring to provide a desired level of stress distribution and stiffness. Features and geometries can be combined in any suitable combination and can be machined, internally formed, additively manufactured, etc. In the illustrated embodiments, the stress reducing features can be proximal to the end gap portions 120 of the retaining ring 110.

Figure 5A:
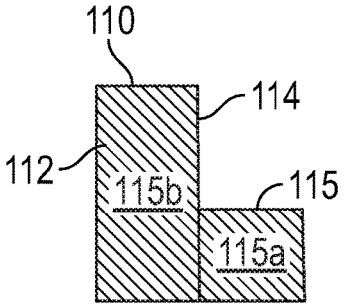
FIGS. 5A-5C are partial end views of various embodiments of retaining rings for use with the rotating disc assembly of FIG. 4.
Figure 5B:
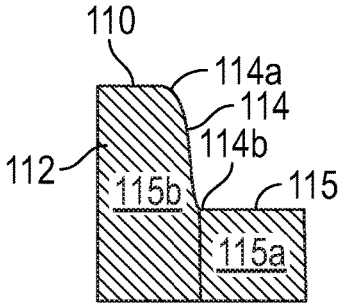
Figure 5C:
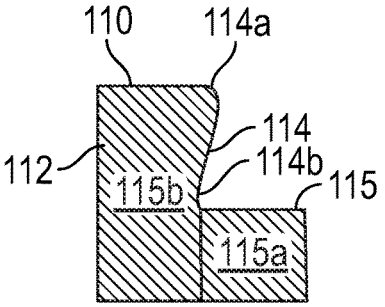

Referring to FIGS. 5A-5C, various embodiments of a retaining ring 110 are shown. In FIGS. 5A-5C, an end view of the end gap portion 120 of the retaining ring 110 is shown. In FIG. 5A, a retaining ring 110 is shown without any stress reducing features present on the rotating disc face 112, the cover plate face 114, or the axially extending face 115. In certain applications, the use of a retaining ring 110 without any stress reducing features may cause high stress concentrations on the cover plate 104. In FIG. 5B, the retaining ring 110 is shown with stress reducing features 114*a*, 114*b*. In the illustrated embodiment, stress reducing features 114*a*, 114*b* are radiused corners that are tangent to the cover plate face 114. In the illustrated embodiment, the stress reducing feature 114*b* is also a radiused corner tangent to the axially extending face 115. In FIG. 5C, the retaining ring 110 is shown with stress reducing features 114*a*, 114*b*. In the illustrated embodiment, stress reducing features 114*a*, 114*b* are contoured contact surfaces formed on the cover plate face 114. In the illustrated embodiment, the stress reducing feature 114*a* can be a contoured contact surface with the cover plate 104.

Figure 6A:
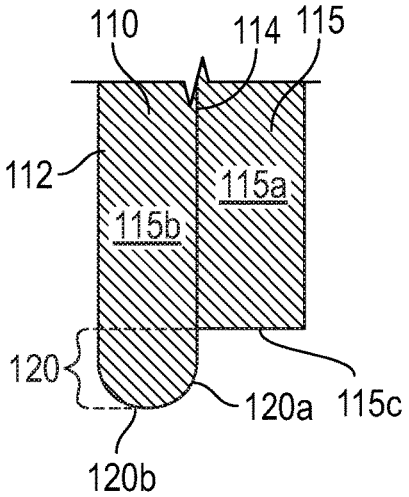
FIGS. 6A-6F are partial plan views of various embodiments of retaining rings for use with the rotating disc assembly of FIG. 4.
Figure 6B:
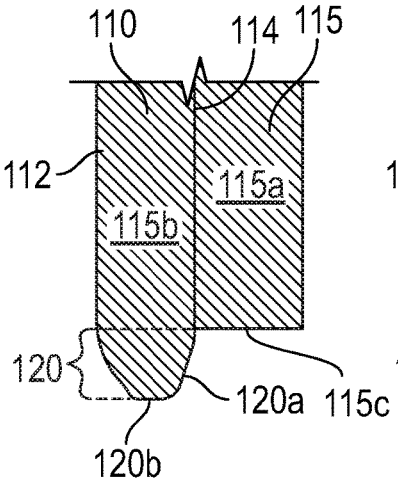
Figure 6C:
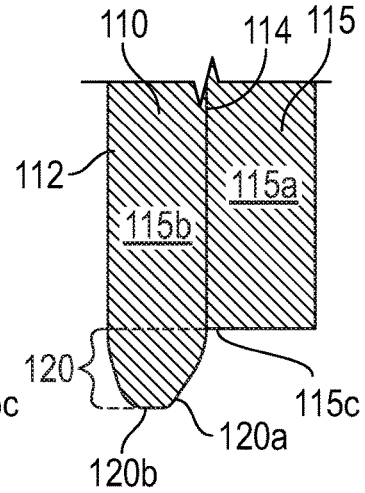
Figure 6D:
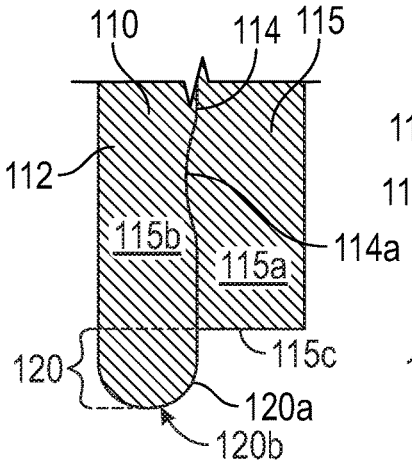
Figure 6E:
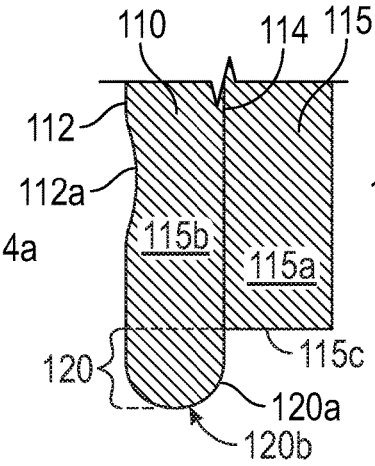
Figure 6F:
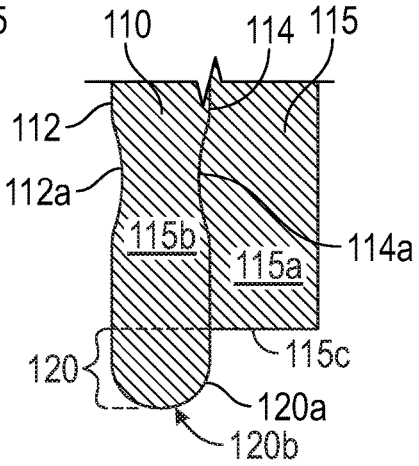

Referring to FIGS. 6A-6F, various embodiments of the retaining ring 110 are shown. In FIGS. 6A-6F, a plan view of the end gap portion 120 of the retaining ring 110 is shown. In the illustrated embodiments, the axially extending face 115 can extend any suitable distance both axially in radially. In certain embodiments, the axially extending face 115 of the first leg 115*a* can end at a first circumferential end 115*c* before the end gap portion 120 or alternatively extend beyond the end gap portion 120. In FIG. 6A, a retaining ring 110 is shown with stress reducing features 120*a* at a second circumferential end 120*b* of the second leg 115*b*. In the illustrated embodiment, the stress reducing feature 120*a* is a radiused corner that is tangent to the cover plate face 114 and the rotating disc face 112. Further, the stress reducing feature 120*a* is disposed on the end gap portion 120 of the retaining ring 110. In FIG. 6B, a retaining ring 110 is shown with stress reducing features 120*a*. In the illustrated embodiment, the stress reducing feature 120*a* is a chamfered or contoured corner that transitions to the cover plate face 114 and the rotating disc face 112. In FIG. 6C, a retaining ring 110 is shown with stress reducing features 120*a*. In the illustrated embodiment, the stress reducing feature 120*a* is an asymmetrical chamfered or contoured corner that transitions to the cover plate face 114 and the rotating disc face 112. In FIG. 6D, a retaining ring 110 is shown with stress reducing features 114*a* and 120*a*. In the illustrated embodiment, the stress reducing feature 114*a* is a scalloped surface within the cover plate face 114. Advantageously, the addition of scalloped surfaces on the retaining ring 110 can increase stiffness in desired areas, such as near the end gap portions 120. In FIG. 6E, a retaining ring 110 is shown with stress reducing features 112*a* and 120*a*. In the illustrated embodiment, the stress reducing feature 112*a* is a scalloped surface within the rotating disc face 112. In FIG. 6F, a retaining ring 110 is shown with stress reducing features 112*a*, 114*a*, and 120*a*. In the illustrated embodiment, the stress reducing feature 112*a* is a scalloped surface within the rotating disc face 112 and the stress reducing feature 114*a* is a scalloped surface within the cover plate face 114, wherein the stress reducing feature 114*a* is opposite to the stress reducing feature 112*a*.

Figure 7A:
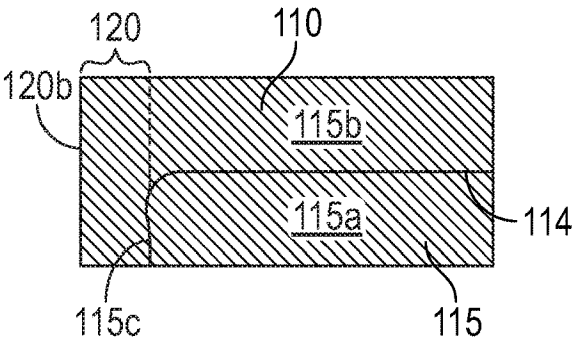
FIGS. 7A-7F are partial elevation views of various embodiments of retaining rings for use with the rotating disc assembly of FIG. 4.
Figure 7B:
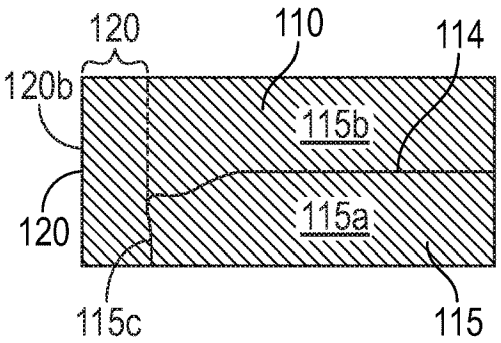
Figure 7C:
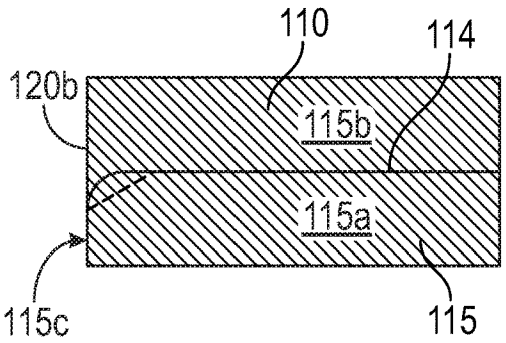
Figure 7D:
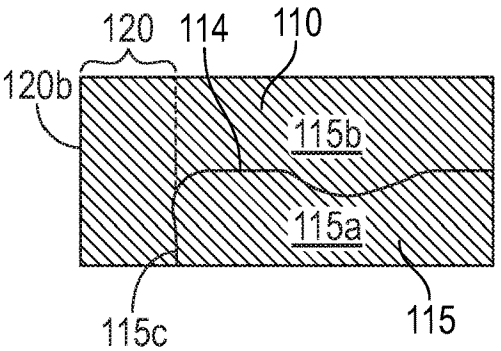
Figure 7E:
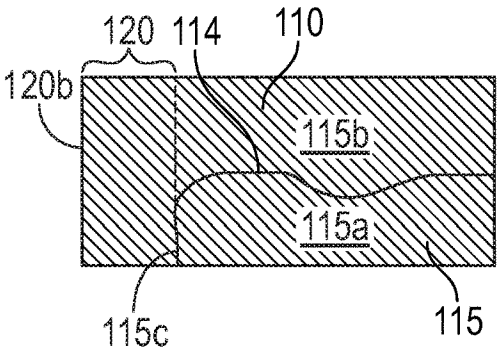
Figure 7F:
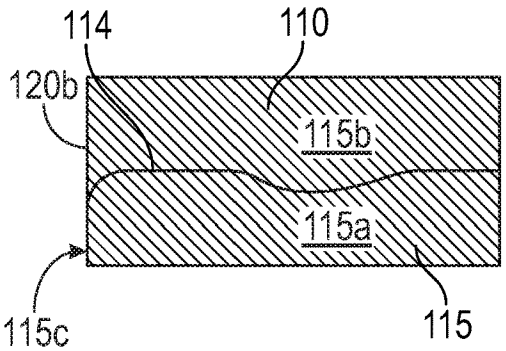

Referring to FIGS. 7A-7F, various embodiments of the retaining ring 110 are shown. In FIGS. 7A-7F, an elevation view of the end gap portion 120 of the retaining ring 110 is shown. In FIG. 7A, a retaining ring 110 is shown with stress reducing features 115*a*. In the illustrated embodiment, the stress reducing feature 115*a* is a radiused corner that is tangent to the axially extending face 115. Further, the stress reducing feature 115*a* is disposed proximal to the end gap portion 120 of the retaining ring 110. In FIG. 7B, a retaining ring 110 is shown with stress reducing features 115*a*. In the illustrated embodiment, the stress reducing feature 115*a* is a scarf cut that can optimize loading of the cover plate 104. In FIG. 7C, a retaining ring 110 is shown with stress reducing features 115*a* and 115*b*. In the illustrated embodiment, the stress reducing feature 115 *a* is a radiused corner that is tangent to the axially extending face 115 and disposed in the end gap portion 120 of the retaining ring 110. Further, the stress reducing feature 115*b* is a scarf cut that is disposed axially toward the cover plate face 114. In FIG. 7D, a retaining ring 110 is shown with stress reducing features 115*a* and 115*b*. In the illustrated embodiment, the stress reducing feature 115*a* is a radiused corner that is tangent to the axially extending face 115. Further, the stress reducing feature 115*b* is a scalloped surface that can optimize stiffness of the retaining ring. In FIG. 7E, a retaining ring 110 is shown with stress reducing features 115*a* and 115*b*. In the illustrated embodiment, the stress reducing feature 115*a* is a contoured corner. Further, the stress reducing feature 115*b* is a scalloped surface that can optimize stiffness of the retaining ring. In FIG. 7F, a retaining ring 110 is shown with stress reducing features 115*a* and 115*b*. In the illustrated embodiment, the stress reducing feature 115*a* is a radiused corner that is tangent to the axially extending face 115 and is disposed in the end gap portion 120 of the retaining ring 110. Further, the stress reducing feature 115*b* is a scalloped surface that can optimize stiffness of the retaining ring.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A retaining ring for use in a gas turbine engine, the retaining ring comprising:

a first leg that is axially extending and includes:

a first face that faces a radial direction and is configured to radially position the retaining ring proximate a cover plate;

a second leg that is radially extending and includes:

a second face that faces a first axial direction to face the cover plate, the second face being adjacent the first face; and a third face that faces a second axial direction to face a rotating disc;

a first circumferential end, wherein the first leg has a first circumferential edge and the second leg has a second circumferential edge;

a surface contour defined by one or more of:

a radially extending contour in one or more of:

the second circumferential edge, the second face proximate the first circumferential end, and the third face proximate the first circumferential end; and an axially extending contour in one or more of:

the first circumferential edge, and the first face proximate the first circumferential end.

2. The retaining ring of claim 1, wherein:

the second leg extends circumferentially beyond the first leg.

3. The retaining ring of claim 1, wherein the first face includes the surface contour.

4. The retaining ring of claim 1, wherein the surface contour is a radius tangent to at least one of the third face, the second face, and the second circumferential edge.

5. The retaining ring of claim 1, wherein the surface contour is a contoured contact surface.

6. The retaining ring of claim 1, wherein the surface contour includes one or more of:

a radially extending scalloped surface in the second face proximate the first circumferential end; and the third face and an axially extending scalloped surface in the first face proximate the first circumferential end.

7. The retaining ring of claim 1, wherein the surface contour is a tapering surface.

8. A rotating disc assembly configured for use with a gas turbine engine, the rotating disc assembly comprising:

a rotating disc;

a cover plate; and a retaining ring disposed between the rotating disc and the cover plate, wherein the retaining ring axially retains the rotating disc and the cover plate, the retaining ring including:

a first leg that is axially extending and includes:

a first face that faces a radial direction and is configured to radially constrain the retaining ring against the cover plate;

a second leg that is radially extending and includes:

a second face that faces an axial inward direction to face the cover plate, the second face being adjacent the first face; and a third face that faces an axial outward direction to face a rotating disc;

a first circumferential end, wherein the first leg has a first circumferential edge and the second leg has a second circumferential edge;

a surface contour defined by one or more of:

a radially extending contour in one or more of:

the second circumferential edge, the second face proximate the first circumferential end, and the third face proximate the first circumferential end; and an axially extending contour in one or more of:

the first circumferential edge, and the first face proximate the first circumferential end.

9. The rotating disc assembly of claim 8, wherein:

the second leg extends circumferentially beyond the first leg.

10. The rotating disc assembly of claim 8, wherein the first face includes the surface contour.

11. The rotating disc assembly of claim 8, wherein the surface contour is a radius tangent to at least one of the second face, the first face, and the second circumferential edge.

12. The rotating disc assembly of claim 8, wherein the surface contour is a contoured contact surface.

13. The rotating disc assembly of claim 8, wherein the surface contour includes one or more of:

a radially extending scalloped surface in the second face proximate the first circumferential end; and the third face and an axially extending scalloped surface in the first face proximate the first circumferential end.

14. The rotating disc assembly of claim 8, wherein the surface contour is a tapering surface.

15. A gas turbine engine, comprising:

a rotating disc assembly, including:

a rotating disc;

a cover plate; and a retaining ring disposed between the rotating disc and the cover plate, wherein the retaining ring axially retains the rotating disc and the cover plate, the retaining ring including:

a first leg that is axially extending and includes:

a first face that faces a radial direction and is configured to radially constrain the retaining ring against the cover plate;

a second leg that is radially extending and includes:

a second face that faces an axial inward direction to face the cover plate, the second face being adjacent the first face; and a third face that faces an axial outward direction to face a rotating disc;

a first circumferential end, wherein the first leg has a first circumferential edge and the second leg has a second circumferential edge;

a surface contour defined by one or more of:

a radially extending contour in one or more of:

the second circumferential edge, the second face proximate the first circumferential end, and the third face proximate the first circumferential end; and an axially extending contour in one or more of:

the first circumferential edge, and the first face proximate the first circumferential end.

16. The gas turbine engine of claim 15, wherein:

the second leg extends circumferentially beyond the first leg.

17. The gas turbine engine of claim 15, wherein the first face includes the surface contours.

18. The gas turbine engine of claim 15, wherein the surface contour is a radius tangent to at least one of the second face, the third face, and the second circumferential edge.

19. The gas turbine engine of claim 15, wherein the surface contour is a contoured contact surface.

20. The gas turbine engine of claim 15, wherein the surface contour includes one or more of:

a radially extending scalloped surface in the second face proximate the first circumferential end; and the third face and an axially extending scalloped surface in the first face proximate the first circumferential end.

* * * * *